US006290447B1

(12) United States Patent
Siemonsen et al.

(10) Patent No.: US 6,290,447 B1
(45) Date of Patent: Sep. 18, 2001

(54) SINGLE STATION BLANKED, FORMED AND CURLED CAN END WITH OUTWARD FORMED CURL

(75) Inventors: Frederik A. Siemonsen, Richmond, VA (US); Donald Nelson, Cockeysville, MD (US)

(73) Assignee: M.S. Willett, Inc., Cockeysville, MD (US)

( * ) Notice: Subject to any disclaimer, the term of this patent is extended or adjusted under 35 U.S.C. 154(b) by 0 days.

(21) Appl. No.: 08/455,859

(22) Filed: May 31, 1995

(51) Int. Cl.[7] ..... B21D 51/44
(52) U.S. Cl. ..... 413/56; 72/348
(58) Field of Search ..... 220/619, 623, 220/906; 72/348; 413/56

(56) References Cited

U.S. PATENT DOCUMENTS

| | | | | |
|---|---|---|---|---|
| 1,100,005 | * | 6/1914 | Young | 220/619 X |
| 1,478,782 | * | 12/1923 | Dewey et al. | 220/619 X |
| 1,890,936 | | 12/1932 | Douglass . | |
| 3,146,749 | | 9/1964 | Heinle . | |
| 3,405,546 | * | 10/1968 | Hoffman et al. | 72/348 |
| 3,608,774 | * | 9/1971 | Saunders | 220/619 |
| 3,638,825 | | 2/1972 | Franek et al. . | |
| 3,844,154 | * | 10/1974 | Bozek | 72/348 X |
| 4,093,102 | * | 6/1978 | Kraska | 220/623 |
| 4,270,475 | | 6/1981 | Fletcher et al. . | |
| 4,467,933 | | 8/1984 | Wilkinson et al. . | |
| 4,560,080 | | 12/1985 | Shepard et al. . | |
| 4,567,746 | | 2/1986 | Bachmann et al. . | |
| 4,571,978 | * | 2/1986 | Taube et al. | 413/56 |
| 4,574,608 | | 3/1986 | Bulso, Jr. et al. . | |
| 4,637,961 | | 1/1987 | Bachmann et al. . | |
| 4,655,358 | | 4/1987 | Kaffko . | |
| 4,704,887 | | 11/1987 | Bachmann et al. . | |
| 4,862,722 | * | 9/1989 | Fraze et al. | 72/348 X |
| 5,287,718 | | 2/1994 | Yamanashi . | |

* cited by examiner

*Primary Examiner*—Peter Vo
*Assistant Examiner*—Louis K. Huynh
(74) *Attorney, Agent, or Firm*—James Creighton Wray; Meera P. Narasimhan

(57) ABSTRACT

A can end is punched from a sheet of material, formed and curled in a single station with a single movement of the punch. An intermediate axial peripheral wall is formed by the blanking punch and a cooperating die core ring. A pressure sleeve surrounding the die core ring has a chamfered inner edge which engages a peripheral edge of the blank at the lower end of the axial peripheral wall. While the formed end is held between the punch and the die, the pressure sleeve moves upward, forcing the peripheral wall outward into a recess, either in the blank punch or the die pressure sleeve, moving the metal outward into the curl. The curl is thus expansion formed rather than compression formed. The formed and curled end is removed from the assemblies by knockout rings.

4 Claims, 5 Drawing Sheets

SINGLE STATION BLANKED, FORMED AND CURLED CAN END WITH OUTWARD FORMED CURL

BACKGROUND OF THE INVENTION

This invention relates to the forming of can ends for seam joining to can bodies. In the art of can making, can ends have been made over 100 years in substantially the same way, by cutting a blank and forming a can end and curling inward the peripheral portion for subsequent assembly to a can body in a seaming machine. The punching and forming of the can end are accomplished in one operation, and then a second operation is required to curl the peripheral portion of the can end inward.

The curling is not an expensive procedure, and many machines are available which perform the curling step. However, the curling step is one additional step which adds expenses and potential problems to can end making. Moreover, the curling for over 100 years has compressed the peripheral material of the can end inward, thus increasing thickness and raising the potential of wrinkling or otherwise deforming the inward curl, which may cause imperfections in the seam and result in a less than perfect seal.

In large can ends, such as used for example in pretzel tins or cookie tins, the curling machines are large and expensive, adding an additional problem which has existed in the prior art.

In the present invention can ends refers to all ends including closure ends. In the beverage industry, for example, there are 2-piece and 3-piece cans. A can body has either one or two can ends. One end usually has a pull tab.

A special problem exists which requires curling of the can ends.

Can ends and cans are formed in high speed equipment. It is necessary to stack can ends together and to be able to separate them quickly and without error when rapidly feeding them to automated down-stream equipment. If there are no curls, the ends would tend to stick together. The peripheral curls aid the separation of the can ends in rapid unstacking operations.

In making can ends, it is conventional to punch and form the can ends in one step, and then to chute the can ends to conventional curling machines to curl the ends and then to stack the ends for transfer to automated down-stream equipment.

The seaming panels have the same diameter increments on small diameter can ends as on large diameter can ends. In large can ends, the seaming area may be a small percentage of the total area of the ends. In small can ends, the seaming panel may be a large percentage of the total end area and material.

In the United States, about 100 billion beverage and beer cans are made out of aluminum annually. One company alone makes about 20 billion cans a year in the U.S., and about an additional billion worldwide.

It can be appreciated that a saving of a single step in the production of can ends for the beverage industry, even while saving only a small amount of money per can end, would be multiplied by a number of ten to the eleventh power through the entire beverage industry, and would amount to substantial savings.

If a savings of metal, for example 1%, could be realized in the manufacture of can ends for the beverage industry, that would be equivalent to the metal used in one billion can ends and would result in a substantial saving.

The saving of metal in can ends is the reason that can bodies are necked-in, which is a common practice, at the present time of this invention.

Long standing needs continue for reducing steps, tooling and machines required for the manufacture of can ends. Long standing needs exist for the reduction of metal used in the manufacture of can ends.

SUMMARY OF THE INVENTION

The present invention solves problems of long standing in the prior art by forming curls on can ends in the same station in which the end blank is punched from a sheet and the end is formed. The can end is blanked, formed and curled in a single station. Thereafter the finished can end is chuted to an accumulator, collector or stacker, which stacks the can ends for transfer to automated down-stream equipment, including but not limited to compound lining and easy opening can end conversion equipment, with the last step being in-seaming equipment use.

The present invention saves additional steps and the application of additional machines to curl the peripheral parts of the can ends.

Uniquely, the present invention curls can ends by moving metal outwardly. The moving of the metal outwardly stretches and thins the metal, reducing thickness of the metal in peripheral flanges and curls, and thus reducing the amount of metal used in can ends.

The present invention tensions and stretches rather than compresses the outer portion of the end during formation, resulting in a savings of metal. The savings of metal is especially significant in small diameter ends. The seaming panels have the same diameter increments on small cans as on large cans. Thus the seaming panels are larger percentages of end areas in small can ends than in large can ends.

The present invention cuts, forms, stretches, tensions and curls the edge and ejects the end at high speed. Before the end comes out of the tool, the upward movement of the outer edge puts tension on the metal and moves the metal outward, stretching and thinning the metal. Because the outward moved metal is stretched, there can be savings in the "blank diameter" or cut edge diameter of a can end. That reduction of the diameter, even by a small amount, can result in a large amount of savings considering the larger number of ends that are made. The present invention makes a better quality end. The conventional curl-forming machine compresses and rolls the metal inwardly, resulting in weakening of the ends and by forming miniature ripples in the curls. That creates the potential for imperfect seams. When tensioned as in the present invention no wrinkles or ripples are formed, because the material expands and flows outward rather than compresses inward as in the prior art.

The invention has four unexpected advantages. The thinning of metal and outward movement to form the curl provide reduction in metal cost. The outward stretching avoids forming compression ripples and results in improvement of the quality of the resulting seam. Doing away with the requirement for conventional curling machines and the conventional added steps of transfer in inserting, curling and removing save production costs and time.

A can end is punched from a sheet of material, formed and curled in a single station with a single movement of the punch. An intermediate axial peripheral wall is formed by the blanking punch and a cooperating die core ring. A pressure sleeve surrounding the die core ring has a chamfered inner edge which engages a peripheral edge of the blank at the lower end of the axial peripheral wall. While the formed end is held between the punch and the die, the pressure sleeve moves upward, forcing the peripheral wall outward into a recess, either in the blank punch or the die pressure sleeve, moving the metal outward into the curl, which is thus expansion formed rather than compression formed. The formed and curled end is removed from the assemblies by a knockout ring.

A preferred can end has a central end panel surrounded sequentially by a reinforcing bead, an annular reinforcing rim, a countersink base, a countersink wall, a flange, a curl having an inward extending portion and a peripheral edge. The curl is formed by moving material outwardly between an outer edge of the cover flange and the peripheral edge.

One preferred can end has a flat central end panel surrounded by a raised bead. A sloping wall extends outward from the bead. A first radius is formed at the end of the sloping wall. A planar wall extends outwardly from the first radius. A second radius is formed at the outer end of the planar wall, and a countersink wall slopes outward from the second radius. A third radius is formed at the outer end of the countersink wall. A flange extends outward from the third radius. A cover hook extends inwardly from the flange and has a peripheral edge at an inner edge of the cover hook. The cover hook and the peripheral edge are formed in a single station by cutting the peripheral edge, moving the peripheral edge downward and inward and forming a transitional wall between the flange and the peripheral edge. Moving the peripheral edge upward extends the vertical wall outward and forms the cover hook.

A preferred can end has a center portion, an annular portion surrounding the center portion, a countersink wall extending generally axially from the annular portion, a flange extending generally radially from the countersink wall, and a curl at a peripheral edge of the flange and extending in a direction of the countersink wall. Preferably the curl and a peripheral portion of the flange adjacent the curl have been formed by generally radial outward movement.

The preferred method of making a can end includes punching a blank from a sheet of material with a blank punch and a blank die, forming a transitional outer wall of the end between the blank punch and a die core ring, and reforming the transitional outer wall by forcing an edge upward and forcing material from the transitional outer wall outward to a recess in the blank punch with a pressure sleeve.

Preferred tooling for forming a can end includes a punch assembly and a die assembly. The die assembly has a blank die, a pressure sleeve, a die core ring, a center lift ring and a center forming die. The punch assembly has a blank punch cooperating with the blank die to cut a can end blank from sheet material between the die assembly and the punch assembly. The blank punch moves in opposition to the pressure sleeve. An upper knockout cooperates with the die core ring to form a flange on the can end blank. A center form punch cooperates with the center lift ring and center form die for forming a countersink wall and an annular area inside the countersink wall. The blank punch has a recess in an inner edge for forming a peripheral curl on a can end as the pressure sleeve is raised.

In the preferred tooling, the pressure sleeve has a chamfered inner edge for engaging a peripheral edge of the can end blank and moving the peripheral edge upward for forming the curl outward in the blank punch recess.

The method of forming a can end and curl preferably includes blanking, forming and curling a can end in a single station. The method includes punching a blank from a sheet of material, forming a central area, an annular area, a countersink wall, a peripheral flange and a peripheral axial wall with cooperating die and punch members in a single station, and reforming the peripheral axial wall outward in a curl recess, which can be located either in the punch or the die assembly, by moving a peripheral edge of the peripheral axial wall in the direction of the flange before releasing the formed end from the punch and die members.

BRIEF DESCRIPTION OF THE DRAWINGS

FIG. 6 shows the punch ready to punch the blank from the sheet of material.

FIG. 7 shows an intermediate step of the upper punch moving downward into the die.

FIG. 8 shows the full movement of the punch into the die. The can cover is fully formed, and the outer peripheral wall is generally vertical, as shown in the intermediate forms of FIGS. 3, 4 and 5.

FIG. 9 shows the upward moving of the pressure sleeve and the blank punch, which forms the curl by the outward stretching of the material from the outer peripheral wall.

FIG. 10 shows the separation of the punch and the die, and the lifting of the formed end.

DETAILED DESCRIPTION OF THE PREFERRED EMBODIMENTS

Figure 1:
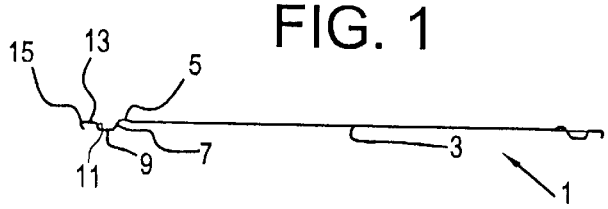
FIG. 1 is a cross-sectional view of a can end.

Referring to FIG. 1, the can end 1 has a flat end center panel 3, which is surrounded by a bead 5. A sloping inner flange or reinforcing rib 7 surrounds the bead 5. A flat radial wall, which is a planar floor 9, extends outward from the annular reinforcing rib 7. An upstanding inner wall, which is a countersink wall 11, extends upward from the planar floor 9. A flange crest 15 extends generally radially outward from the countersink wall 11, and a curl 15 extends outward and then inward from the outer end of the peripheral flange 13.

Figure 2:
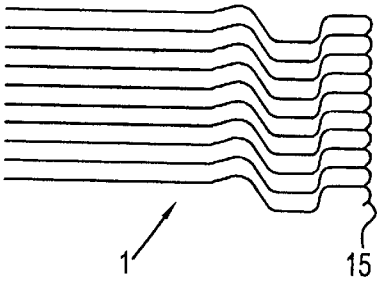
FIG. 2 is a detail of stacked can ends showing how the curl separates the ends.

As shown in FIG. 2, the curls 15 provide separation of the ends when the ends are stacked.

Figure 3:
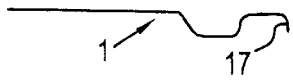
FIG. 3 is a detail of the can end during forming before curl formation.
Figure 4:
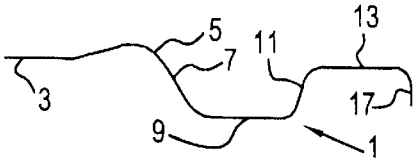
FIG. 4 is an enlarged detail of the can end shown in FIG. 2.
Figure 5:
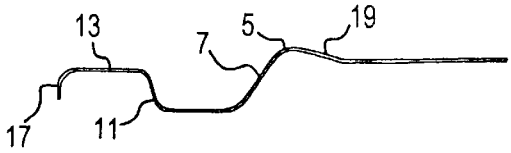
FIG. 5 is an enlarged detail showing examples of preferred radii.

FIGS. 3, 4 and 5 show features of the end 1 in an intermediate form before the curl is formed on the terminal peripheral flange or end wall 17.

FIG. 5 shows the location of radii between elemental features of the can ends. Radii R1 at inner and outer ends of the cover flange 13 are substantially equal to the radii R1 at the inner end of the countersink wall 11. The radii R2 at the inner and outer ends of the reinforcing rib 7 are substantially larger than radii R1.

Radii R6 at the inner end of the inward sloping wall 19 of bead 5 are greater than radii R1.

In the completed embodiment of the can end, the peripheral axial wall 17 will be used to form the cover hook or curl 15. When the can end 1 is joined to the can body, the cover flange 13 and the curl 15 are used to form the seam.

As schematically shown in the sequences of FIGS. 6–10, can end 1 is formed by a punch assembly 21 and a die assembly 31. The punch assembly has a blank punch 23, an upper knockout 25 and a center formed punch 27. The outer edge of the blank punch 23 cooperates with the inner edge of the blank die 29 in the die assembly 31 to sever the can end blank 41 from the sheet material 43. Directly opposite parts of the punch assembly are complementary parts of the die, pressure sleeve 33, the die core ring 35, the center lift ring 37 and the center form die 39.

Figure 6:
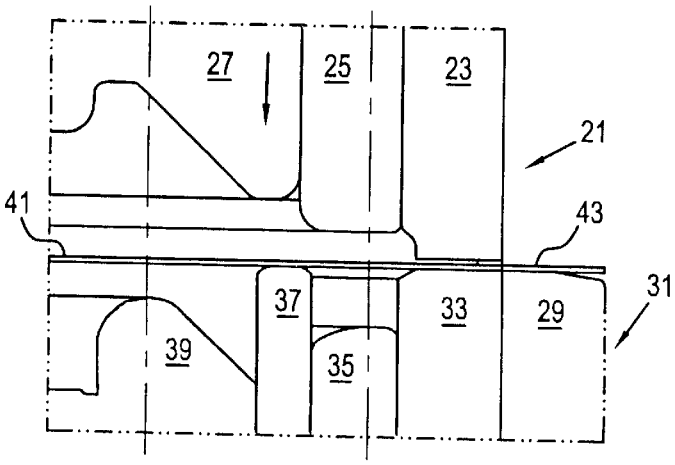
FIGS. 6, 7, 8, 9 and 10 are details of the blanking and sequential steps of the forming of the can end and the lifting of the can end from the die.
Figure 7:
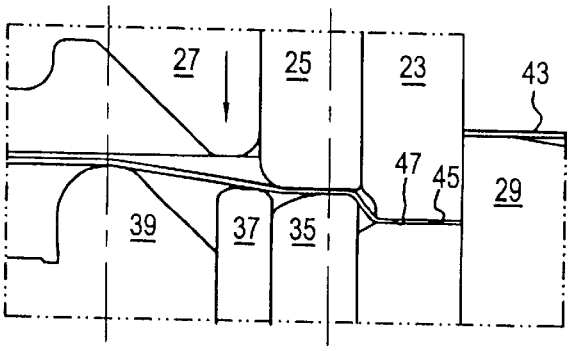

As shown in FIG. 6, as the blank punch 23 moves partially down into the die carrying the severed outer edge 45 of the blank, some of the parts of the can end begin to take form.

Figure 8:
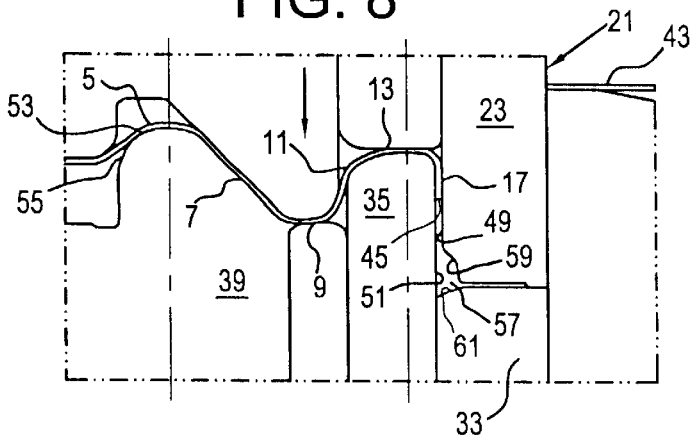

As shown in FIG. 8, the punch 21 is at bottom dead center. The intermediate form of the can end as shown in FIGS. 3, 4 and 5 has been formed. The outer edge 45 has moved in the formation of transitional wall 17 to a position between the inner wall 49 of blank punch 23 and the outer wall 51 of the die core ring 35. The bead 5 has been formed by stretching the material over the curved upper surface 53 of the bead-forming portion 55 of the center form die 39.

As shown in FIG. 8, a space 57 is formed between the curl-forming recess 59 in the blank punch 23 and the sloping upper surface 61 of the pressure sleeve 33.

During the upstroke of the punch, the sloping wall 61 traps the outer edge 45 of the can end and forces the metal from transitional outer wall 17 to stretch outward to form the curl 15. At the same time the flange 13 is stretched outward.

Since the peripheral portion of the flange 13 moves outward in forming the curl 15, and since the curl 15 is formed outward by moving the metal away from the initial position of the transitional wall 17 along wall 51, an amount of metal is saved. The savings in metal is accounted for because if peripheral wall 17 were curled inward as is conventional, flange 13 would have to be made with a greater outer diameter to provide for the inward curl of the peripheral wall 17. The savings in metal may be substantial for each large area can end and less substantial for each individual smaller can end. However, the savings compared to total area are greater in small ends than in large ends. Moreover, the saving of even one percent of metal would provide a potential savings of metal equivalent to that used in one billion can ends in the United States alone.

Figure 9:
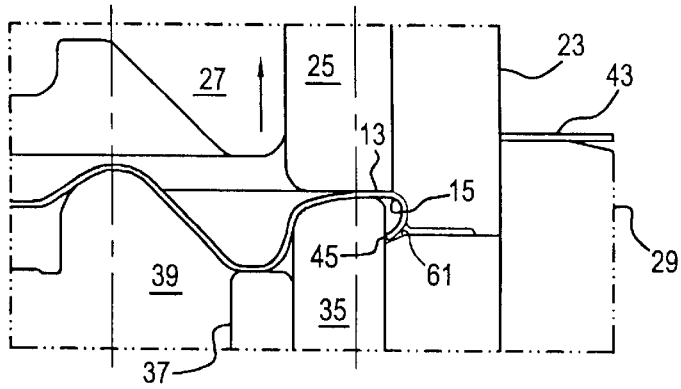

The forming of the curl as shown in FIG. 9 results in the single station manufacture of a can end, and avoids the steps and expense of transferring the can end to a curling machine and separately curling the can end. The invention also avoids the expense of a curling machine.

Separately and in addition to the savings of metal and the savings of steps and expense in separate curling, the present invention provides improved curls and thus improved can ends and improved seams in cans. That is because when the material is stretched to form the curl, as shown in FIG. 9, instead of being compressed to form the curl, as in the prior art, the stretching avoids the formation of ripples which tend to occur during the compression of the metal such as by bending the peripheral wall 17 inward to form the curl, as in the prior art.

Figure 10:
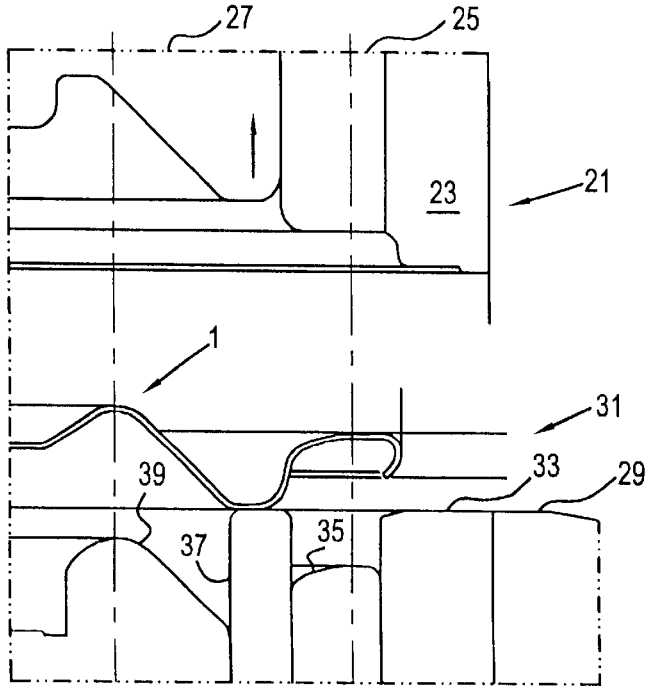

Referring to FIG. 10, the finished can end is lifted from the die assembly by the center lift ring 37.

Figure 11:
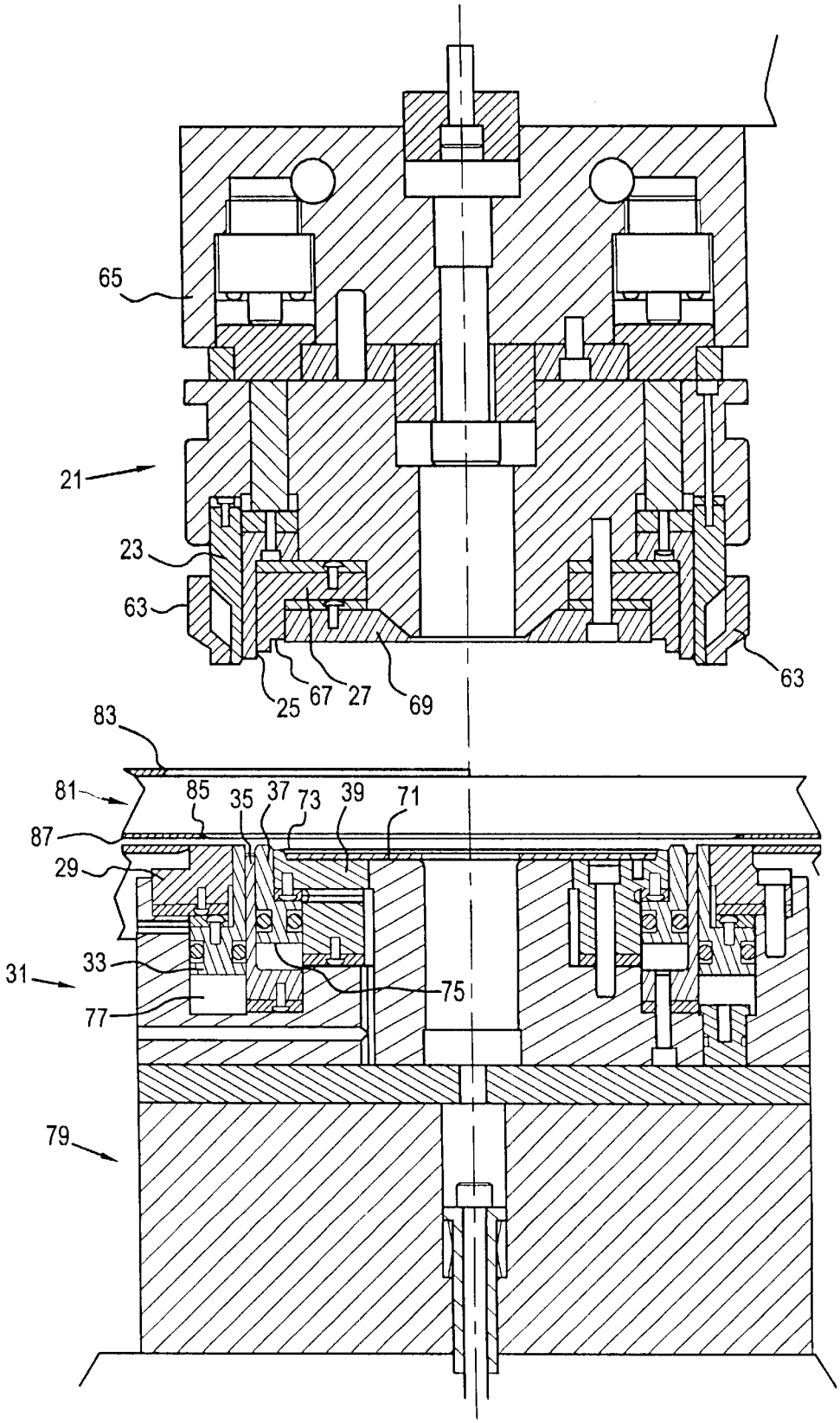
FIG. 11 is a preferred embodiment of the punch and die assemblies at the single station used to form and curl can ends.

FIG. 11 shows the punch 21 and die 31. A gripper 63 surrounds the blanking punch 23 to press the sheet of material against the blanking die 29. Blanking punch 23 slides with respect to gripper 63 when the punch head 65 is further lowered. The upper knockout 25 is resiliently mounted to oppose the die core ring 35. The center form punch 27 has a recess 67 for permitting forming of the reinforcing bead. A flat central portion 69 of the center form punch 27 contacts an annular area of the center of the can end. The annular center punch plate 69 is opposed by the annular center die plate 71, which is part of the center form die 39. Center form die 39 also has a peripheral bead-forming portion 73, which cooperates with recess 67 in the outer portion of center form punch 27 in forming the bead.

A chute 81 has openings 83 and 85 through which the punch assembly moves. The chute conveys the finished products away from the die assembly. The chute material is fed in the space 87 between the chute and the die assembly.

The center lift ring 37 moves upward with fluid pressure from annular cylinder 75 to lift the formed can end. Outer pressure sleeve 33 moves downward under the force of the blanking punch 23, and then moves upward from fluid pressure in chamber 77 to form the curl in cooperation with the inner edge recess in the blanking punch 23. The die assembly 31 moves with the die bed.

Figure 12:
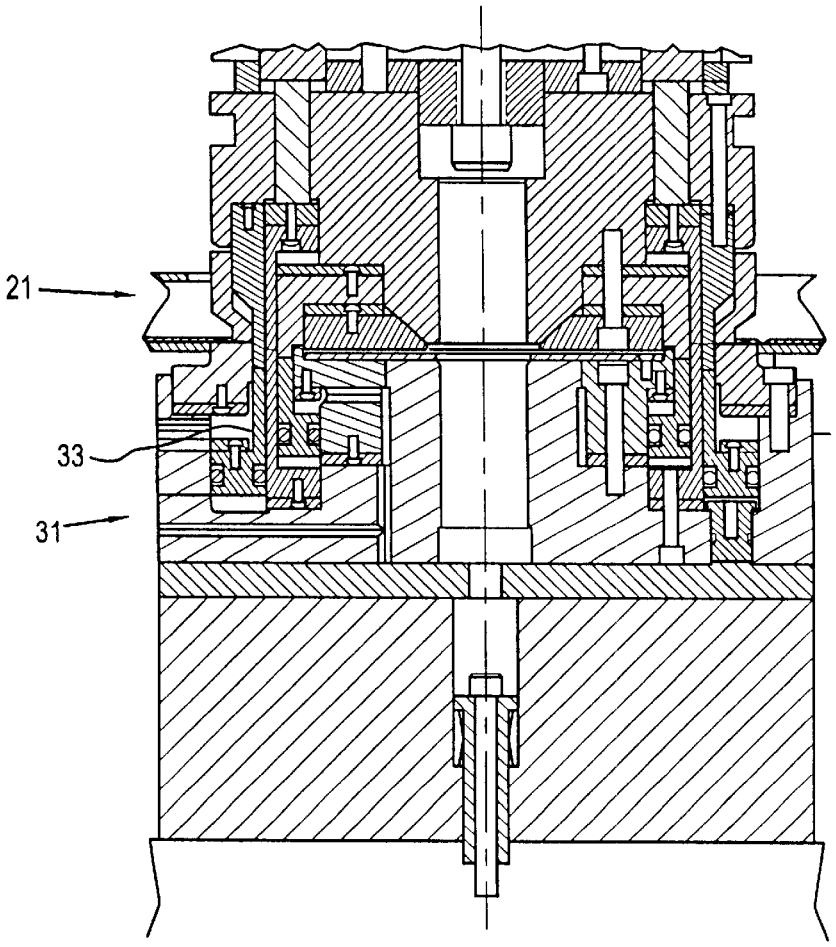
FIG. 12 shows the punch and die of FIG. 11 in their fully closed position, with the can end in an intermediate condition before the curl is formed.

The can end 1 is represented by a line in FIG. 12, which shows the punch 21 and the die 31 in their lower bottom dead center position before the pressure sleeve 33 is raised to form the curl.

Figure 13:
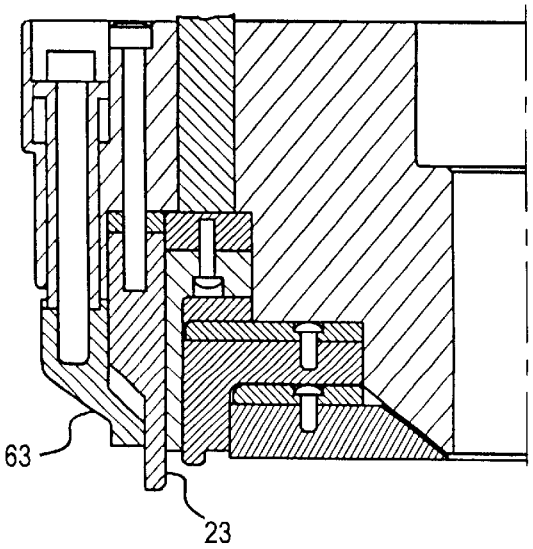
FIGS. 13 and 14 are details of the gripper and punch.
Figure 14:
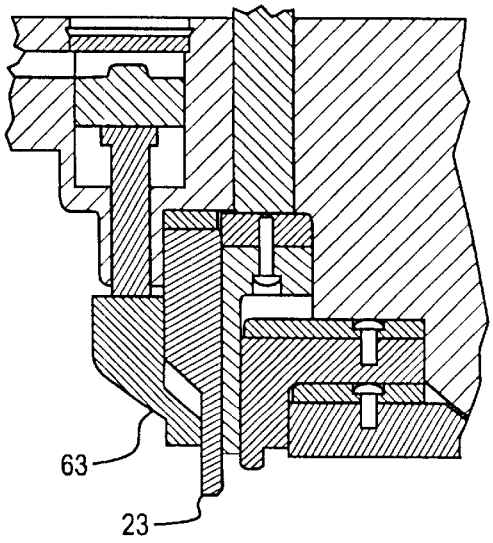

FIGS. 13 and 14 are details which show apparatus for relative movement of the gripper 63 with respect to the blanking punch 23.

Figure 15:
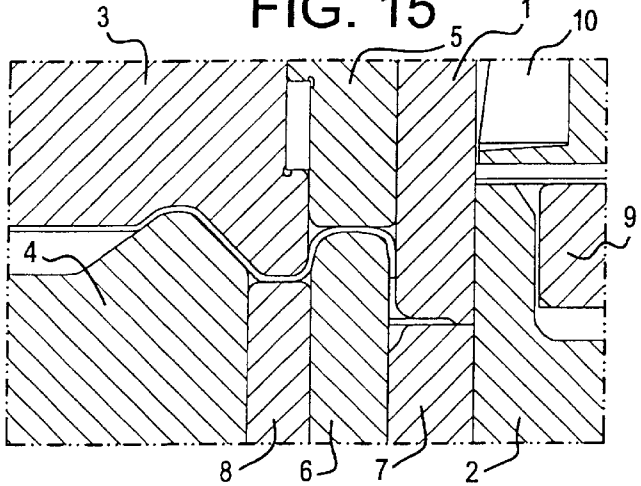

FIG. 15 shows the tooling and press at bottom dead center (BDC); forming of the shell (less curling) has been completed.

Figure 16:
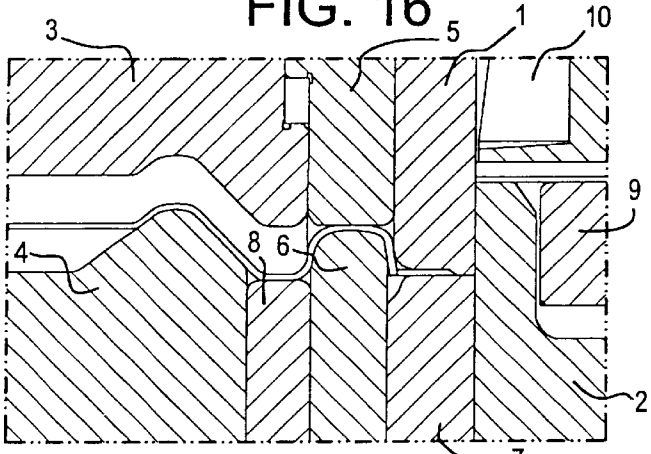
FIGS. 15–18 schematically show sequential slips in combination curling shell tooling.

In FIG. 16 the tooling and press are moving toward top dead center (TDC). The vertical flange is ready for the curling operation; it has expanded slightly outward because of metal springback. This springback is controlled by the amount of punch and die clearance at this point. It is suggested that the initial tooling gap should start with metal gage plus 10% and gradually be increased if necessary.

Figure 17:
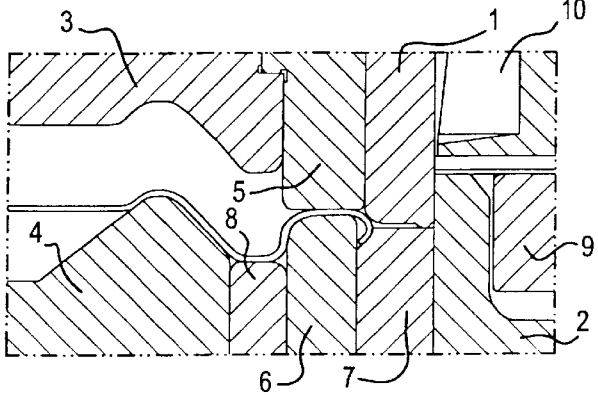

FIG. 17 shows the tooling and press moving toward TDC. Curling is complete.

Figure 18:
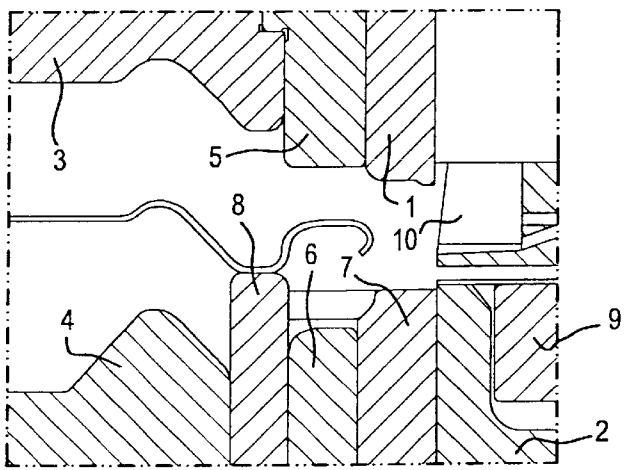

FIG. 18 shows the tooling and press :moving toward TDC. The finished shell has been lifted up to feed line level and is ready for ejection. The shells are ejected in the opposite direction of stock feed.

These and further and other objects and features of the invention are apparent in the disclosure, which includes the above and ongoing written specification, with the claims and the drawings.

While the invention has been described with reference to specific embodiments, modifications and variations of the invention may be constructed without departing from the scope of the invention, which is defined in the following claims.

We claim:

1. Tooling for forming a can end having a punch assembly and a die assembly, the die assembly having independently movable concentric components sequentially including a blank die, a pressure sleeve, a die core ring, a center lift ring and a center form die, and the punch assembly having a blank punch cooperating with the blank die to cut a can end blank from sheet material between the die assembly and the punch assembly, and for movement in opposition to the pressure sleeve, an upper knockout for cooperating with the die core ring to form a flange on the can end blank, a center form punch for cooperating with the center lift ring and center form die for forming a countersink wall and an annular area inside the countersink wall, the blank punch having a recess in an inner edge for forming a peripheral curl on a can end extending on the die core ring towards the pressure sleeve as the pressure sleeve is raised towards the blank punch and the can end.

2. The tooling of claim 1, wherein the pressure sleeve has a chamfered inner edge for engaging a peripheral edge of the can end blank and moving the peripheral edge upward for forming the curl outward in the blank punch recess.

3. Tooling for forming a can end having a punch assembly and a die assembly, the die assembly having independently movable concentric components sequentially including a blank die, a pressure sleeve, a die core ring, a center lift ring and a center form die, and the punch assembly having a blank punch cooperating with the blank die to cut a can end blank from sheet material between the die assembly and the punch assembly, and for movement in opposition to the pressure sleeve, an upper knockout for cooperating with the die core ring to form a flange on the can end blank, a center form punch for cooperating with the center lift ring and center form die for forming a countersink wall and an annular area inside the countersink wall, the pressure sleeve having a recess in an inner edge for forming a peripheral curl on a can end as the pressure sleeve is raised towards the blank punch and towards the can end extending on the die core ring towards the pressure sleeve.

4. The tooling of claim 3, wherein the blank punch has a recess on an inner edge and wherein the recess of the pressure sleeve is a chamfered inner edge for engaging a peripheral edge of the can end blank and moving the peripheral edge upward for forming the curl outward in the blank punch recess.

* * * * *